United States Patent [19]

Aycock et al.

[11] 4,140,319

[45] Feb. 20, 1979

[54] BOARD GAME

[76] Inventors: Kenneth W. Aycock, Rte. 2, Box 31AA, Kenly, N.C. 27542; Edwin D. Ellis, Box 526, Spindale, N.C. 28160

[21] Appl. No.: 820,900

[22] Filed: Aug. 1, 1977

[51] Int. Cl.[2] ..... A63F 3/00

[52] U.S. Cl. ..... 273/256; 273/288

[58] Field of Search ..... 273/256, 257, 269, 282, 273/284, 288; 35/7 R, 7 A, 16

[56] References Cited

U.S. PATENT DOCUMENTS

| | | | |
|---|---|---|---|
| 2,026,082 | 12/1935 | Darrow | 273/256 |
| 2,901,255 | 8/1959 | Sutherland | 273/288 X |

FOREIGN PATENT DOCUMENTS

| | | | |
|---|---|---|---|
| 491948 | 4/1953 | Canada | 273/269 |

*Primary Examiner*—Anton O. Oechsle

*Attorney, Agent, or Firm*—Bell, Seltzer, Park & Gibson

[57] ABSTRACT

A board game for a plurality of players including the following. A playing board has an endless course thereon for being progressively and periodically traversed in turn by each player during play of the game and comprises a plurality of serially connected playing spaces having indicia thereon for individually identifying respective spaces and the affect of game play upon a player occupying such spaces during traversing of the course. Certain of the contiguous spaces are designated by the indicia for defining distinguishable groups of predetermined numbers of the spaces and providing for the opportunity of acquisition of the spaces of the groups upon a player first occupying a respective one of the spaces of the groups for progressively accumulating all or part of the spaces of the respective groups for differently affecting game play upon another player subsequently occupying any one of the acquired spaces. A plurality of playing pieces is provided for individual use by the players in traversing the course on the board. A device is operable by the players in sequence for randomly determining the number of the spaces to be traversed per turn by the playing piece of each player. A plurality of transparent overlays are provided for respective acquisition by the players and for being placed over predetermined numbers of the spaces of the groups upon acquisition of the spaces of the groups and the overlay for further differently affecting game play upon another player subsequently occupying any of the acquired spaces with the overlay thereon, while allowing visual observation of the indicia on the spaces through the transparent overlay thereon.

15 Claims, 9 Drawing Figures

Fig-1
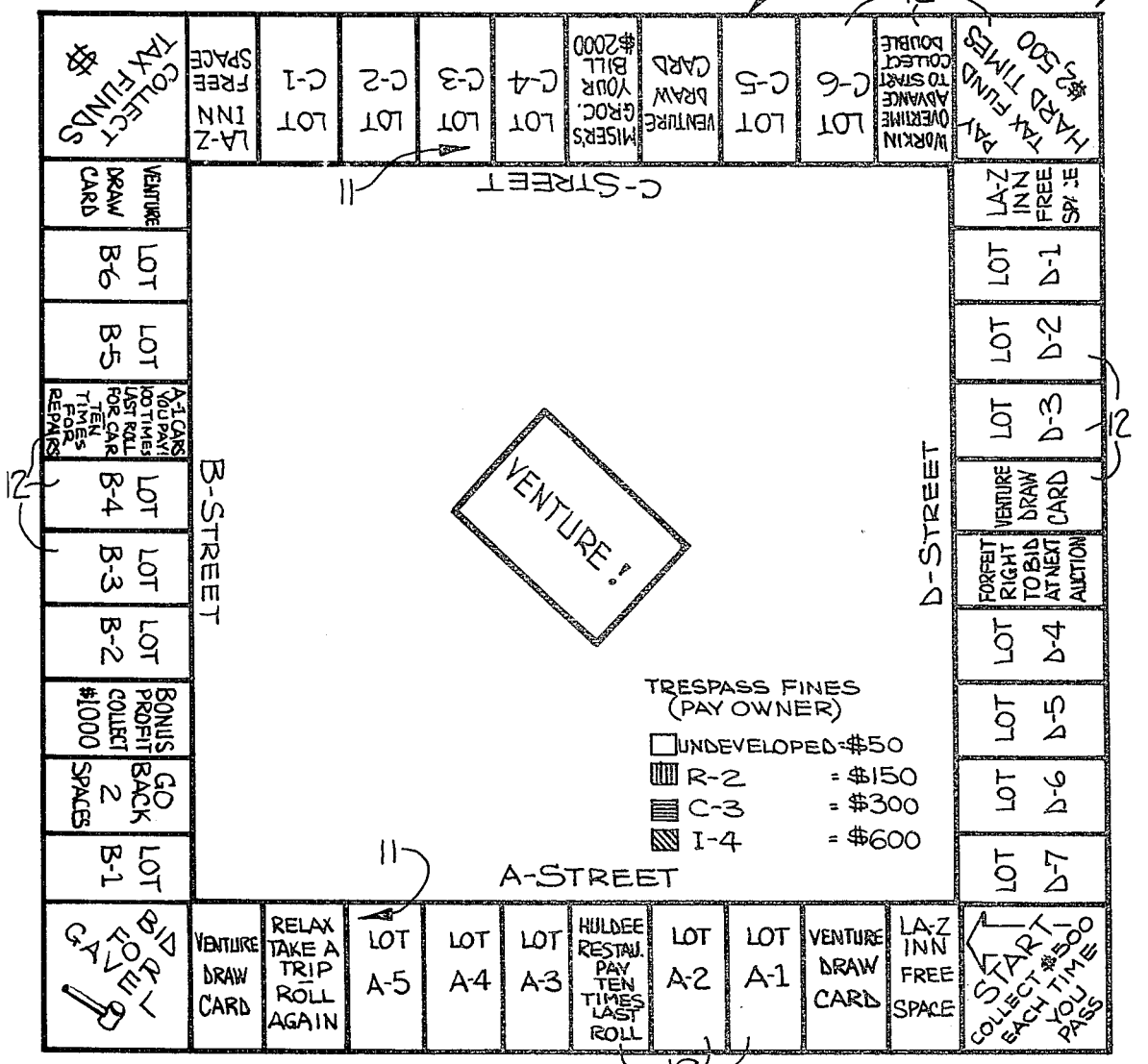
Fig-2
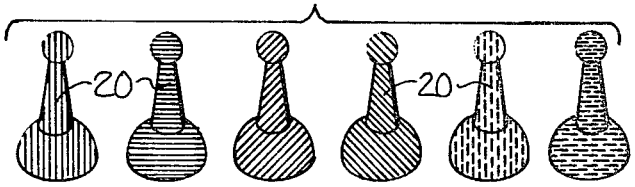
Fig-3
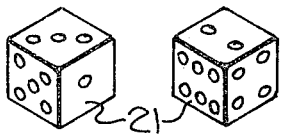
Fig-4
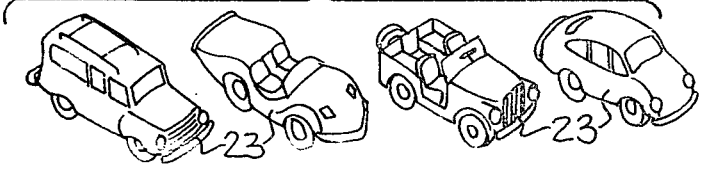
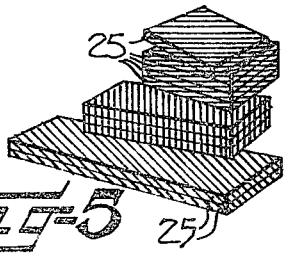
Fig-5

BOARD GAME

This invention relates to a new and novel board game for a plurality of players and, more particularly, to a board game involving, inter alia, the concept of auctioning of property lots and individual property to be acquired by the individual players for purposes of collecting trespass fines when other players subsequently occupy such property lots and individual property and for re-zoning the property lots to different classes of zoning to acquire increased trespass fines.

BACKGROUND OF THE INVENTION

The board game of the present invention may be categorized with those types of board games in which a substantially flat playing board is utilized and the upper surface thereof is provided with suitable markings for defining an endless course or playing path for being progressively and periodically traversed in turn by each player during play of the game and which includes a plurality of serially connected playing spaces having indicia thereon for identifying the respective spaces and the affect of game play upon a player occupying such spaces during traversing of the course. During play of these types of board games, playing pieces or tokens representing the individual players are moved through the course and along the spaces and a variety of situations are presented to each of the players by the element of chance and skill to thereby effect the competitive standing or position of the players participating in the game. In time, one of the players eventually emerges the winner and the game is terminated.

Many of these types of board games merely involve movement of the players' pieces through the playing course in a manner determined by chance in accordance with means, such as dice, a dial indicator or pointer arranged to be spun, and the like. The game is thus reduced to merely a game of chance which is primarily of amusement value with very little educational or instructive worth. Some of these types of board games are designed to add the element of skill to the play so that a player can enhance his chances of winning by the application of good judgment, ability, skill and the like. However, most of the latter type games which require some element of skill or the like on the part of the players are still primarily games of chance and provide very little educational experience or the acquiring of a skill in any particular area. Moreover, the games tend to become boring inasmuch as the affect of game play upon a player occupying one of the spaces along the playing course is normally the same during each traverse by each of the players of the playing course.

Examples of prior art patents on the above-described types of board games which were considered with respect to the present invention, are as follows:

| U.S. Pat. No. | Inventor | Issue Date |
|---|---|---|
| 748,626 | Magie | January 5, 1904 |
| 1,704,619 | Markman | March 5, 1929 |
| 2,026,082 | Darrow | December 31, 1935 |
| 2,693,961 | Ripley, Jr. | November 9, 1954 |
| 2,717,157 | Dylewski | September 6, 1955 |
| 2,976,044 | Corpening | March 21, 1961 |
| 3,582,080 | Schick | June 1, 1971 |
| 3,704,018 | Fyanes | November 28, 1972 |
| 3,759,521 | Breslow et al | September 18, 1973 |
| 3,796,432 | Beakley | March 12, 1974 |
| 3,807,739 | Henley et al | April 30, 1974 |
| 3,850,433 | Purlia | November 26, 1974 |
| 3,865,380 | Thomas | February 11, 1975 |
| 3,951,411 | Hill et al. | April 20, 1976 |

-continued

| U.S. Pat. No. | Inventor | Issue Date |
|---|---|---|
| 3,961,795 | Anspach | June 8, 1976 |
| 3,970,313 | Montemayor | July 20, 1976 |
| Design 240,842 | Montemayor | August 3, 1976 |
| 3,977,680 | Lavine | August 31, 1976 |
| Design 241,457 | Hall | September 14, 1976 |
| Design 241,562 | Skoler | September 21, 1976 |
| 3,994,500 | Schow | November 30, 1976 |

OBJECTS AND SUMMARY OF THE INVENTION

Accordingly, it is the object of this invention to provide a new and novel board game of the general type described above and which further provides varying affects on game play upon a player occupying the same spaces on the playing course during the play of the game.

It is a further object of this invention to provide a board game of the type described above which provides an educational experience and the ability to acquire a particular skill.

It has been found by this invention that the above objects may be accomplished by providing a board game for a plurality of players comprising broadly, in combination, the following elements.

A playing board has an endless playing course thereon for being progressively and periodically traversed in turn by each player during play of the game and comprises a plurality of serially connected playing spaces having indicia means thereon for individually identifying respective spaces and the effect of game play upon a player occupying such spaces during the traversing of the course. Certain of the contiguous spaces are designated by the indicia means for defining distinguishable groups of predetermined numbers of the spaces and providing for the opportunity of acquisition of the spaces of the groups upon a player first occupying a respective one of the spaces of the groups for progressively accumulating all or part of the spaces of the respective groups for differently affecting game play upon another player subsequently occupying any one of the acquired spaces.

A plurality of playing pieces for individual use by the players in traversing the course on the board is provided. Means are operable by the players in sequence for randomly determining the number of the spaces to be traversed per turn by the playing piece of each player.

A plurality of transparent overlay means are provided for respective acquisition by the players and for being placed over predetermined numbers of the spaces of the groups upon acquisition of the spaces of the groups and the overlay means for further differently affecting game play upon another player subsequently occupying any of the acquired spaces with the overlay means thereon, while allowing visual observation of the indicia means on the spaces through the transparent overlay means.

Artificial money is preferably provided for use by the players in purchasing for acquisition certain of the spaces of the course upon a player first occupying these certain spaces. Chance cards are preferably provided for being randomly drawn by a player upon selected events occurring during play of the game and have indicia means thereon for identifying the affect of game play by the card being drawn by a player. Deed cards may be provided having indicia thereon identifying individual cards with individual spaces designed for acquisition to be provided to the player acquiring such spaces. The means for randomly determining the number of spaces to be traversed may comprise dice having numerical indicia thereon for being rolled by the players in turn.

Preferably, certain other of the spaces on the endless playing course of the playing board are designated by the indicia for effecting game play upon a player occupying such other spaces and including the opportunity of acquisition of some of the certain other spaces upon a player first occupying some of the other spaces for differently affecting game play upon another player subsequently occupying any one of the certain other spaces.

Accordingly, it may be seen that a board game, generally in accordance with the above broad description, provides for variety through acquisition of contiguous spaces and transparent overlay means for the placing of the transparent overlay means by a particular player over contiguous spaces he has acquired to differently affect game play upon another player subsequently occupying any of the acquired spaces with the overlay means thereon. This eliminates the problems of prior board games in monotonous continuous affect on game play each time a player occupies a particular space on the playing course of the playing board.

In order to accomplish the above-described object of providing the opportunity for an educational experience and the acquiring of a skill through playing of the board game of this invention, a preferred embodiment of the above broadly described board game has been specifically designed for purchasing of spaces and transparent overlay means through auctioning of such spaces upon a player first occupying any one of such spaces on the playing course of the playing board. Additionally, it is preferable to provide a particular space for auctioning of the gavel of the auctioneer each time any one of the players lands on the particular space so as to provide a learning experience in acting as the auctioneer. Further details of the specifically designed auction board game will be presented in the detailed description of a preferred embodiment of this invention, to follow. However, it may be seen that this specifically designed board game does provide the opportunity for the use of skill, judgment, experience, etc. and the opportunity for obtaining a skill in the art of auctioning.

BRIEF DESCRIPTION OF THE DRAWINGS

Some of the objects and advantages of the invention having been stated, other objects and advantages will appear when taken in connection with the accompanying drawings, in which:

FIG. 1 is a top plan view of a playing board which may be utilized for the present invention;

FIG. 2 is a perspective view of a plurality of playing pieces which may be utilized by the various players, each playing piece having color symbols thereon representing distinguishable colors for each player;

FIG. 3 is a perspective view of a pair of dice which may be utilized as the means operable by the players in sequence for randomly determining the number of spaces to be traversed per turn by the playing piece of each player;

FIG. 4 is a perspective view of a plurality of token automobiles which are utilized with respect to one of the spaces of the playing board in playing of the game;

FIG. 5 is a perspective view of transparent overlays having distinguishable color symbols thereon which are utilized in playing of the game;

DETAILED DESCRIPTION OF PREFERRED EMBODIMENT

Figure 6:
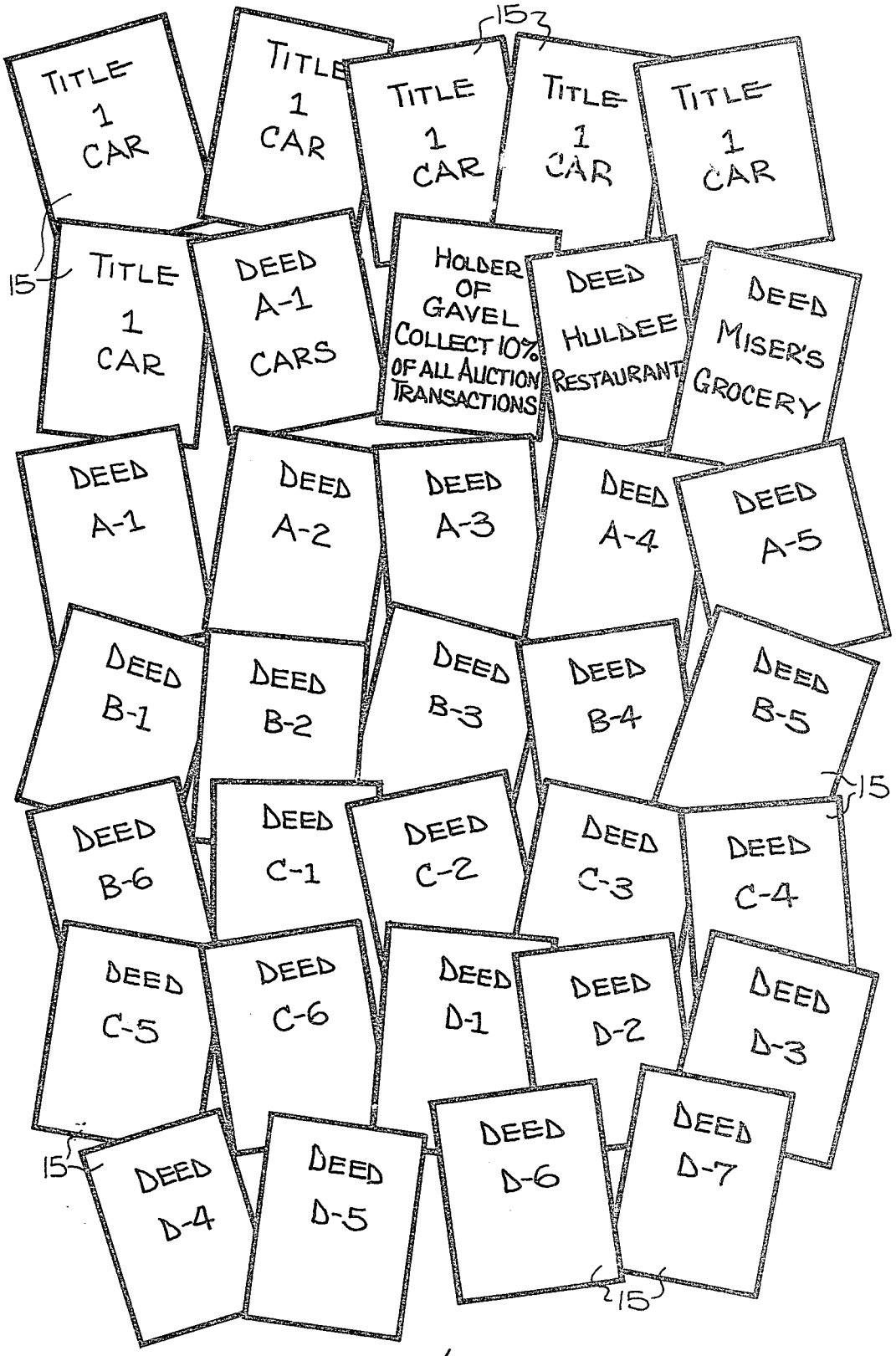
FIG. 6 illustrates a set of deed cards which may be utilized in playing of the game.

Referring now to the drawings, there is illustrated therein a preferred embodiment of a specifically designed auction board game in accordance with the broad description given above of the board game of this invention. While this specifically designed auction board game is the preferred embodiment of this invention, it is believed that the novel concepts of a board game, as described broadly above, may be utilized in connection with other types of board games.

As may be seen in FIG. 1, the auction board game for a plurality of players comprises firstly a playing board, generally indicated at 10, having an endless playing course 11 marked thereon around the outer periphery thereof for being progressively and periodically traversed in turn by each player during play of the game. The endless playing course 11 comprises a plurality of serially connected playing spaces 12 having indicia thereon for individually identifying respective spaces and the affect of game play upon a player occupying such spaces 12 during the traversing of the course 11.

Certain of the contiguous spaces 12 are designated by the indicia means as property lots, see indicia marking spaces 12 as property lots "LOT A-1" and "LOT A-2;" "LOT A-3," "LOT A-4" and "LOT A-5;" "LOT B-1;" "LOT B-2," "LOT B-3" and "LOT B-4;" "LOT B-5" and "LOT B-6;" "LOT C-1," "LOT C-2," "LOT C-3" and "LOT C-4;" "LOT C-5" and "LOT C-6;" "LOT D-1," "LOT D-2" and "LOT D-3;" and "LOT D-4," "LOT D-5,""LOT D-6" and "LOT D-7." These property lots define distinguishable groups of different predetermined numbers, i.e., 2, 3 and 4, of property lots and provide for the opportunity of purchase by any of the players by auctioning of the property lots upon a player first occupying a respective one of the property lots for progressively purchasing all or part of the property lots of the respective groups for collecting trespass fines upon another player subsequently occupying one of the purchased property lots of the groups.

Certain other of the spaces 12 are designated by the indicia means as specific types of individual property separate from the groups and having specifically designated affects on game play including the payment of money upon a player occupying the individual property and providing for the opportunity of purchase by any of the players by auctioning of this property upon a player first occupying this property, see playing spaces 12 designated by indicia as "HULDEE restaurant," "A-1 CARS" and "MISER'S grocery."

Certain other of the playing spaces 12 are designated by the indicia means as other than property spaces for auction and have specific instructions for actions to be taken upon a player occupying such spaces, see playing spaces 12 marked "START," "LA-Z INN," "RELAX!," "VENTURE," "BID for GAVEL," "GO BACK," "BONUS!," "collect TAX FUND," "WORKING OVERTIME," "HARD TIMES" and "FORFEIT."

The auction board game 10 further includes, as shown in FIG. 6, deed cards 15 having indicia thereon identifying individual cards with the property lots and the individual property for providing to the player purchasing the property lots and the individual property at auction for indicating ownership thereof.

Figure 7:
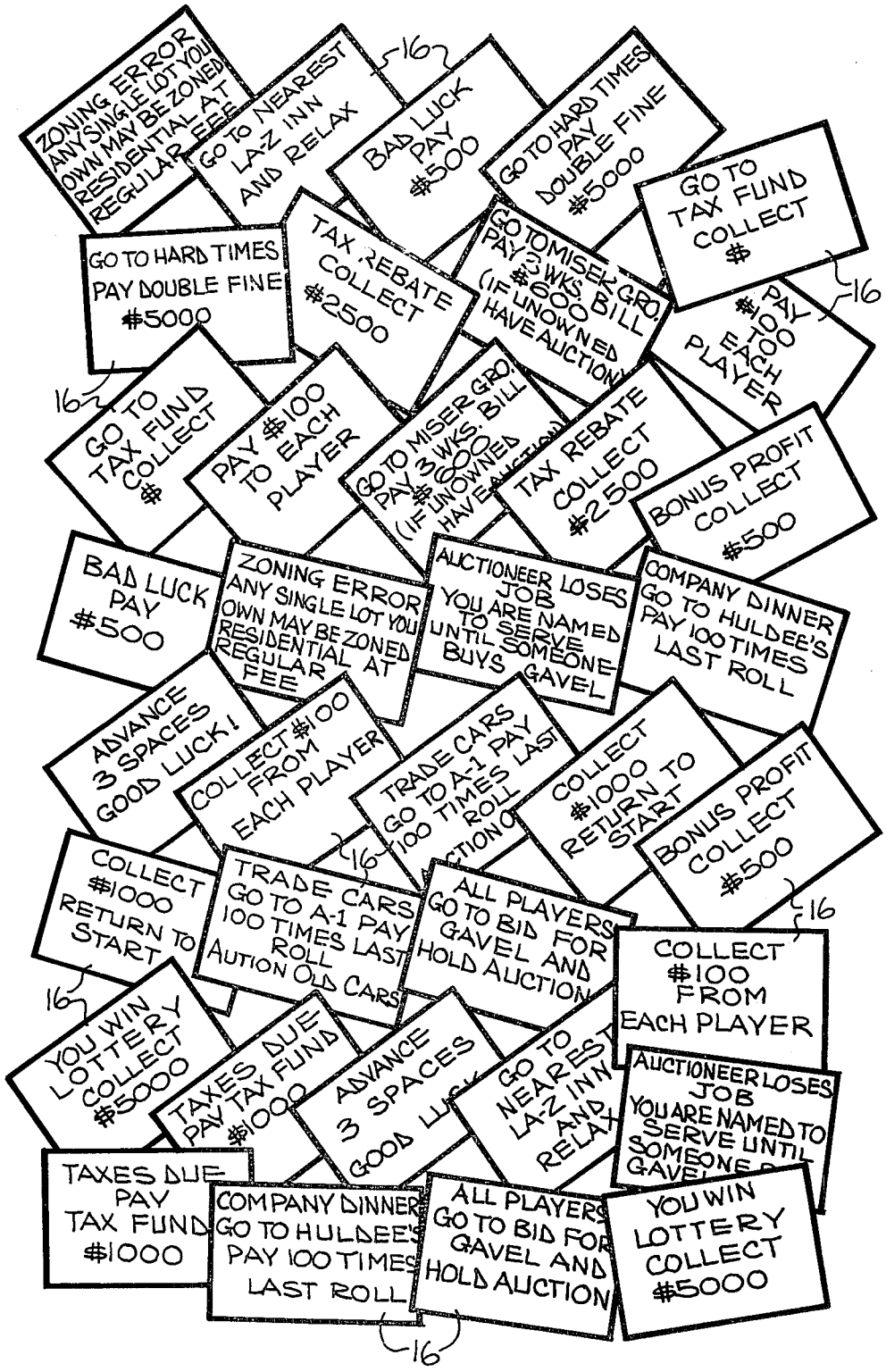
FIG. 7 illustrates a set of chance cards which may be utilized in playing of the game.

As shown in FIG. 7, chance cards 16 are also provided for being randomly drawn by a player upon occupying selected ones of the certain other spaces not designated as property spaces and having indicia thereon indicating "VENTURE" and indicating "DRAW CARD." The chance cards 16 include indicia thereon, as may be seen in FIG. 7, providing specific instructions to the player drawing such card for affecting game play.

Figure 8:
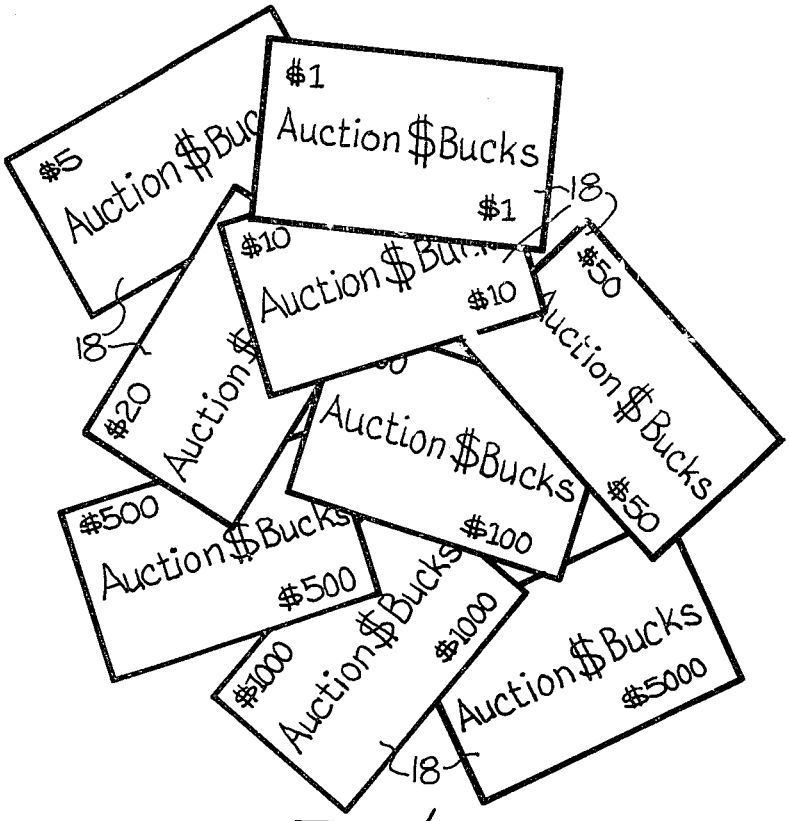
FIG. 8 illustrates artificial money in various denominations which may be utilized in playing of the game.

As shown in FIG. 8, artificial money 18 in varying denominations is provided for supplying to the players in predetermined amounts for use in purchasing property lots and specific property and for paying fines and other payments required during game play.

A plurality of playing pieces 20 are provided, as shown in FIG. 4, for individual use by a player in traversing the course 11 on the board 10. These playing pieces 20 may be identical, as shown in FIG. 4, and of different colors for distinguishing different players or the playing pieces may be of different shapes, etc. for distinguishing the players.

Means, such as the dice 21 shown in FIG. 3 and having numerical indicia thereon, are provided for being operable by the players in sequence for randomly determining the number of spaces to be traversed per turn by the playing pieces 20 of each player.

As shown in FIG. 4, a plurality of token automobiles 23 may be provided for use with the space 12 marked by the indicia means as "A-1 CARS" in a manner described below.

A plurality of transparent re-zoning overlays 25, as shown in FIG. 5, are provided for respective purchase by any of the players by auctioning thereof upon a player first purchasing a predetermined number of the contiguous property lots, such as for example "LOT A-1" and "LOT A-2" or "LOT B-2," "LOT B-3" and "LOT B-4," and for being placed over or held for placing over predetermined numbers of the purchased contiguous property lots for re-zoning of the purchased contiguous property lots to collect increased trespass fines upon another player subsequently occupying any of the purchased property lots with the re-zoning overlay means thereon, while allowing visual observation of the indicia means on the property lots through the transparent re-zoning overlay thereon.

These transparent overlays 25 are provided in different sizes for being placed over two contiguous property lots, three contiguous property lots and four contiguous property lots and are differentiated by color according to the size and number of contiguous property lots to be overlaid. The greater number of contiguous property lots upon which a single overlay means is placed results in greater trespass fine, as indicated in the lower right hand corner of the playing board 10 as illustrated in FIG. 1.

Figure 9:
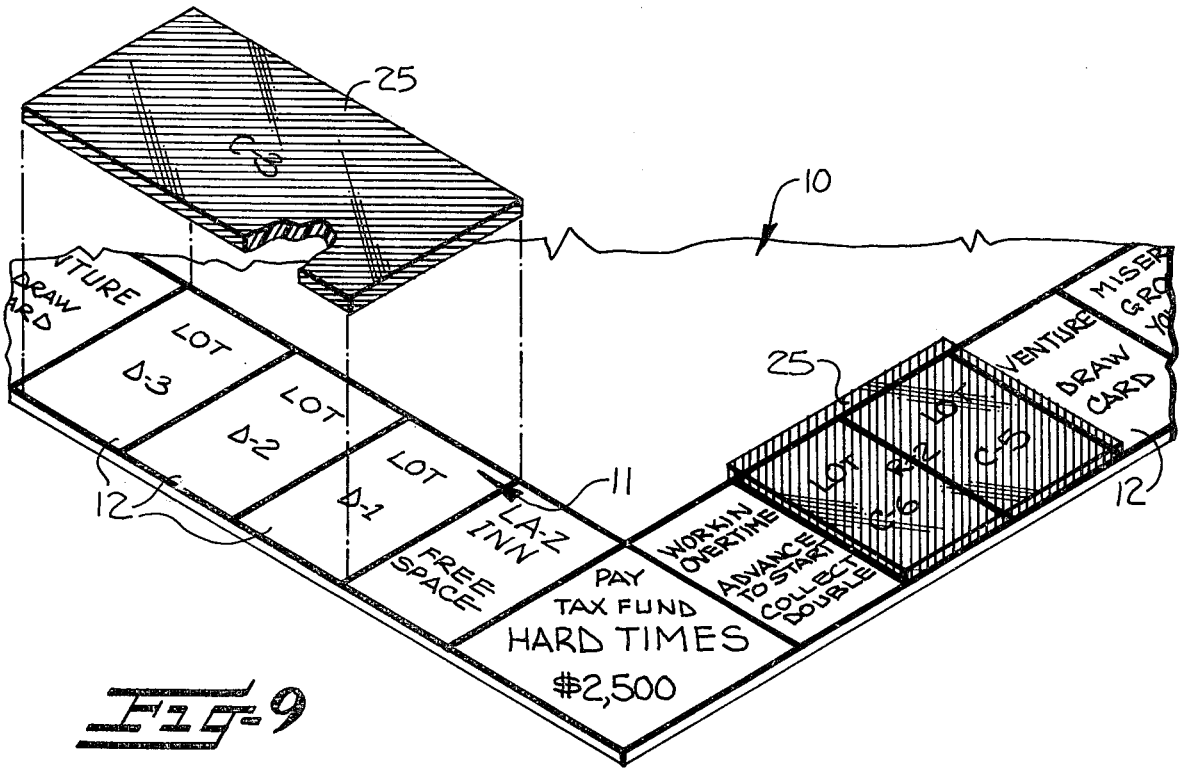
FIG. 9 is an enlarged perspective view, partially exploded, illustrating one corner of the playing board of FIG. 1 with a transparent overlay in position on two contiguous spaces of the playing course and with a transparent overlay exploded from the playing board for being placed in position on three contiguous spaces of the playing course.

For purposes of illustrating the use of the transparent overlays 25, see FIG. 9 which illustrates a two-lot overlay 25 in position over spaces 12 designated by indicia as "LOT C-5" and "LOT C-6" and a three-lot overlay 25 exploded from spaces 12 designated by the indicia as "LOT D-1," "LOT D-2" and "LOT D-3."

As indicated above, one of the certain other spaces 12 on the course 11 of the playing board 10 not designated as property is designated by the indicia means as "BID FOR GAVEL" for providing the opportunity to purchase by auction the gavel of the auctioneer each time a player occupies this one space 12 and collect as auctioneer a predetermined amount of each purchase by the players.

The auction board game of this invention may be played according to the following instructions provided with the game:

INSTRUCTIONS

1. Choose a banker to handle money for game
   Each player receives $20,000 in money as follows:
   - $5,000 bills (2)
   - $1,000 bills (7)
   - $500 bills (6)
   - $100 bills (5)
   - $50 bills (6)
   - $20 bills (6)
   - $10 bills (5)
   - $5 bills (5)
   - $1 bills (5)
2. All players bid to serve as auctioneer. High bidder becomes auctioneer until someone lands on the bid square and everyone again bids for the right. The auctioneer receives 10% of all transactions until someone outbids him for the right.
3. Players then roll dice and proceed around board. When a player lands on a space the property is placed at auction. High bidder receives the deed.
4. When a player acquires adjoining lots a zoning auction is held. All players bid even though they don't have adjoining lots. High bidder receives a zoning overlay. If he has adjoining lots he may use the overlay. If not, he may hold the overlay until he acquires a sufficient number of adjoining lots to enable him to rezone his undeveloped properties. For Example:
   - 2 lots may be rezoned residential property (R-2)
   - 3 lots may be rezoned commercial property (C-3)
   - 4 lots may be rezoned industrial property (I-4)
5. Property zoned in one manner may be rezoned when a player successfully acquires enough adjoining lots and the proper zoning overlay to rezone the property. The previous zoning overlay may be sold at auction or held for future use. There is a limited number of zoning overlays so as the game progresses, overlays may become scarce.
6. When a player lands on another player's property he pays the owner a trespass fine based on how the property is zoned. Note: When a player lands on the restaurant, car lot, or grocery store, he pays fines according to stipulations of the property. For example: when a player lands on A-1 cars, he first must purchase a car. If he owns a car, he must pay for repairs each time he lands on A-1 cars.

7. Lots that are developed at the time of purchase are subject to stipulations and fees depending on the type of property. For example: A-1 cars owner receives the income produced by the car lot.
8. A player has the right to place any or all of his property for sale at auction at any time during the game.
9. The play proceeds until one player emerges as the owner of all property and all other players have been forced out of the game by going bankrupt.
10. All fines are payed into the tax fund and when a player lands on this space he or she collects the accumulated money.

NOTE: Proceeds derived from bidding for gavel are deposited in the tax fund. For example, if you pay $500 to serve as auctioneer the $500 goes to the tax fund. Until someone lands on the bid for the gavel space and another auction is held for the right to serve you receive 10% of all property transactions.

Thus, it may be clearly seen that the board game of this invention provides, in its broadest aspect, a game which eliminates the problem of monotonous, continuous effect on game play each time a player occupies a particular space on the playing course of the board game and provides for variations or changes in the affects of game play upon a player subsequently occupying the same space during progression of the game. Also, the preferred embodiment of the board game of this invention provides an opportunity for the use of skill, judgment, experience, etc. and the opportunity for obtaining a skill in the specific art of auctioning.

In the drawings and specification there has been set forth a broad description and a preferred embodiment of the invention, and although specific terms are employed, they are used in a generic and descriptive sense only and not for purposes of limitation, the scope of the invention being defined in the claims.

What is claimed is:

1. A board game for a plurality of players comprising, in combination:

a playing board having an endless playing course thereon for being progressively and periodically traversed in turn by each player during play of said game and comprising a plurality of serially connected playing spaces having indicia means thereon for individually identifying respective spaces and the affect of game play upon a player occupying such spaces during the traversing of said course;

certain of said contiguous spaces being designated by said indicia means for defining distinguishable groups of predetermined numbers of said spaces and providing for the opportunity of acquisition of said spaces of said groups upon a player first occupying a respective one of said spaces of said groups for progressively accumulating all or part of said spaces of said respective groups for differently affecting game play upon another player subsequently occupying any one of said acquired spaces;

a plurality of playing pieces for individual use by the players in traversing said course on said board;

means operable by the players in sequence for randomly determining the number of said spaces to be traversed per turn by said playing piece of each player; and a plurality of transparent overlay means of respective different sizes for respective acquisition by the players and for being placed over predetermined numbers of said spaces of said groups upon acquisition of said spaces of said groups and said overlay means for further differently affecting game play upon another player subsequently occupying any of said acquired spaces with said overlay means thereon, while allowing visual observation of said indicia means on said spaces through said transparent overlay means thereon.

2. A board game, as set forth in claim 1, further including artificial money for use by the players in purchasing for acquisition certain of said spaces of said course upon a player first occupying said certain spaces.

3. A board game, as set forth in claim 1, further including chance cards for being randomly drawn by a player upon selected events occurring during play of said game and having indicia means thereon for indicating the affect of game play by said card being drawn by a player.

4. A board game, as set forth in claim 1, in which said means for randomly determining the number of said spaces to be traversed comprises dice having numerical indicia thereon for being rolled by the players in turn.

5. A board game for a plurality of players comprising, in combination:

a playing board having an endless playing course thereon for being progressively and periodically traversed in turn by each player during play of said game and comprising a plurality of serially connected playing spaces having indicia means thereon for individually identifying respective spaces and the affect of game play upon a player occupying such spaces during the traversing of said course;

certain of said contiguous spaces being designated by said indicia means for defining distinguishable groups of predetermined different numbers of said spaces and providing for the opportunity of purchase of said spaces of said groups upon a player first occupying a respective one of said spaces of said groups for progressively purchasing all or part of said spaces of said respective groups for differently affecting game play upon another player subsequently occupying one of said purchased spaces of said groups;

certain other of said spaces being designated by said indicia for affecting game play upon a player occupying said other spaces and including providing for the opportunity of acquisition of some of said certain other spaces upon a player first occupying said some of said certain other spaces for differently affecting game play upon another player subsequently occupying any one of said certain other purchased spaces;

chance cards for being randomly drawn by a player upon occupying selected ones of said certain other spaces of said course and having indicia means thereon for indicating the affect of game play by said card being drawn by a player;

artificial money for use by the players in purchasing said spaces of said course designed for purchase upon a player first occupying said spaces;

a plurality of transparent overlay means of respective different sizes for respective purchase by the players and for being placed over the predetermined numbers of said spaces of said groups upon purchase of said spaces of said groups and said overlay means for further differently affecting game play upon another player subsequently occupying any of said purchased spaces with said overlay means thereon, while allowing visual observation of said indicia means on said spaces through said transparent overlay means thereon;

a plurality of playing pieces for individual use by a player in traversing said course on said board; and means operable by the players in sequence for randomly determining the number of said spaces to be traversed per turn by said playing piece of each player.

6. An auction board game for a plurality of players comprising, in combination:

a playing board having an endless playing course thereon for being progressively and periodically traversed in turn by each player during play of said game and comprising a plurality of serially connected playing spaces having indicia means thereon for individually identifying respective spaces and the affect of game play upon a player occupying such spaces during the traversing of said course;

certain of said contiguous spaces being designated by said indicia means as property lots for defining distinguishable groups of predetermined numbers of said property lots and providing for the opportunity of purchase by any of said players by auctioning of said property lots upon a player first occupying a respective one of said property lots for progressively purchasing all or part of said property lots of said respective groups for collecting trespass fines upon another player subsequently occupying one of said purchased property lots of said groups;

artificial money to be provided the players in predetermined amounts for use in purchasing said property lots upon auctioning thereof;

a plurality of playing pieces for individual use by the players in traversing said course on said board;

means operable by the players in sequence for randomly determining the number of said spaces to be traversed per turn by said playing piece of each player; and a plurality of transparent overlay re-zoning means of respective different sizes for respective purchase by any of the players by auctioning thereof upon a player first purchasing predetermined numbers of said contiguous property lots and for being placed over or held for placing over predetermined different numbers of said purchased contiguous property lots for re-zoning of said purchased contiguous property lots into different classes according to the number of said contiguous property lots having said overlay means thereon to collect increased different trespass fines upon another player subsequently occupying any of said purchased property lots with said re-zoning overlay means thereon, while allowing visual observation of said indicia means on said property lots through said transparent re-zoning overlay means thereon.

7. An auction board game, as set forth in claim 6, in which said transparent overlay re-zoning means of different sizes comprise overlay means of different colors according to the sizes thereof for identifying the different trespass fines.

8. An auction board game, as set forth in claim 6, in which certain other of said spaces on said course of said playing board being designated by said indicia means as specific types of individual property not subject to re-zoning and having specifically designated affects on game play including the payment of money upon a player occupying said certain other spaces and providing for the opportunity of purchase by any of said players by auctioning of said property upon a player first occupying said property.

9. An auction board game, as set forth in claim 8, further including deed cards having indicia thereon identifying individual cards with said property lots and said individual property to be provided the player purchasing said property lots and said individual property.

10. An auction board game, as set forth in claim 6, in which certain other of said spaces on said course of said playing board being designated by said indicia means as other than property spaces and having specific instructions for actions to be taken upon a player occupying said spaces, and said game further including chance cards for being randomly drawn by a player upon occupying selected one of said certain other of said spaces and having indicia means thereon providing specific instructions to the player for affecting game play.

11. An auction board game, as set forth in claim 10, in which one of said certain other spaces on said course of said playing board being designated by said indicia means for providing the opportunity to purchase by auctioning the gavel of auctioneer each time a player occupies said one space and collect as auctioneer a predetermined amount of each purchase by the players.

12. An auction board game, as set forth in claim 6, in which said means for randomly determining the number of said spaces to be traversed comprises dice having numerical indicia thereon for being rolled by the players in turn.

13. An auction board game for a plurality of players comprising, in combination:

a playing board having an endless playing course thereon for being progressively and periodically traversed in turn by each player during play of said game and comprising a plurality of serially connected playing spaces having indicia means thereon for individually identifying respective spaces and the affect of game play upon a player occupying such spaces during the traversing of said course;

certain of said contiguous spaces being designated by said indicia means as property lots for defining distinguishable groups of predetermined numbers of said property lots and providing for the opportunity of purchase by any of said players by auctioning of said property lots upon a player first occupying a respective one of said property lots for progressively purchasing all or part of said property lots of said respective groups for collecting trespass fines upon another player subsequently occupying one of said purchased property lots of said groups;

certain other of said spaces being designated by said incidia means as specific types of individual property separate from said groups and having specifically designated affects on game play including the payment of money upon a player occupying said individual property and providing for the opportunity of purchase by any of said players by auctioning of said property upon a player first occupying said property;

certain other of said spaces being designated by said indicia means as other than property spaces and having specific instructions for actions to be taken upon a player occupying said spaces;

deed cards having indicia thereon identifying individual cards with said property lots and said individual property to be provided the player purchasing said property lots and said individual property for indicating ownership thereof;

chance cards for being randomly drawn by a player upon occupying selected ones of said certain other of said spaces not designated as property spaces and having indicia thereon providing specific instructions to the player for affecting game play;

artificial money to be provided the players in predetermined amounts for use in purchasing;

a plurality of transparent overlay re-zoning means of respective different sizes for respective purchase by any of the players by auctioning thereof upon a player first purchasing predetermined numbers of said contiguous property lots and for being placed over or held for placing over predetermined numbers of said purchased contiguous property lots for re-zoning of said purchased contiguous property lots to collect increased trespass fines upon another player subsequently occupying any of said purchased property lots with said re-zoning overlay means thereon, while allowing visual observation of said indicia means on said property lots through said transparent re-zoning overlay means thereon;

a plurality of playing pieces for individual use by a player in traversing said course on said board; and means operable by the players in sequence for randomly determining the number of said spaces to be tranversed per turn by said playing piece of each player.

14. An auction board game, as set forth in claim 13, in which said transparent overlay re-zoning means of respective different sizes comprise overlay means of different colors for being placed over different numbers of said contiguous property lots and for re-zoning of said property lots into different classes according to the number of said contiguous property lots having said overlay means thereon and for indicating different trespass fines to be collected according to the color thereof.

15. An auction board game, as set forth in claim 14, in which one of said certain other spaces on said course of said playing board not designated as property being designated by indicia means for providing the opportunity to purchase by auctioning the gavel of auctioneer each time a player occupies said one space and collect as auctioneer a predetermined amount of each purchase by the players.

* * * * *